United States Patent [19]

Fuerste

[11] Patent Number: 4,557,279

[45] Date of Patent: Dec. 10, 1985

[54] METHOD AND DEVICE FOR DISCOURAGING CIGARETTE SMOKING

[76] Inventor: William C. Fuerste, 1360 S. Grandview, Dubuque, Iowa 52001

[21] Appl. No.: 521,977

[22] Filed: Aug. 11, 1983

[51] Int. Cl.[4] ..... A24D 3/04

[52] U.S. Cl. ..... 131/270; 131/346

[58] Field of Search ..... 131/270, 346, 339

[56] References Cited

U.S. PATENT DOCUMENTS

| | | | |
|---|---|---|---|
| 3,194,246 | 7/1965 | Mantchev | 131/346 |
| 3,651,819 | 3/1972 | Beard | 131/339 |
| 4,306,576 | 12/1981 | Moon | 131/346 |

FOREIGN PATENT DOCUMENTS

| | | | |
|---|---|---|---|
| 2212349 | 10/1973 | Fed. Rep. of Germany | 131/346 |

*Primary Examiner*—V. Millin

*Attorney, Agent, or Firm*—Zarley, McKee, Thomte, Voorhees & Sease

[57] ABSTRACT

A device for discouraging cigarette smoking is disclosed comprising a cigarette filter having a mouthpiece oppositely disposed from a cigarette holder with a passageway therebetween. A filter paper is treated to be invisibly pervious only within the configurations of the letters of a word or words directed to the dangers of smoking. The treated filter paper is located in said passageway to close the free passage of smoke from the cigarette holder to the mouthpiece.

The method of discouraging cigarette smoking is disclosed comprising the use of the foregoing structure wherein a cigarette is placed in the cigarette holder, the cigarette is lighted, and the smoke is withdrawn from the lighted cigarette so that the smoke from the lighted cigarette will move from the cigarette through the pervious portions of the filter paper, whereupon the letters of the words will entrap smoke particles so as to make the letters of the word or words visible.

4 Claims, 7 Drawing Figures

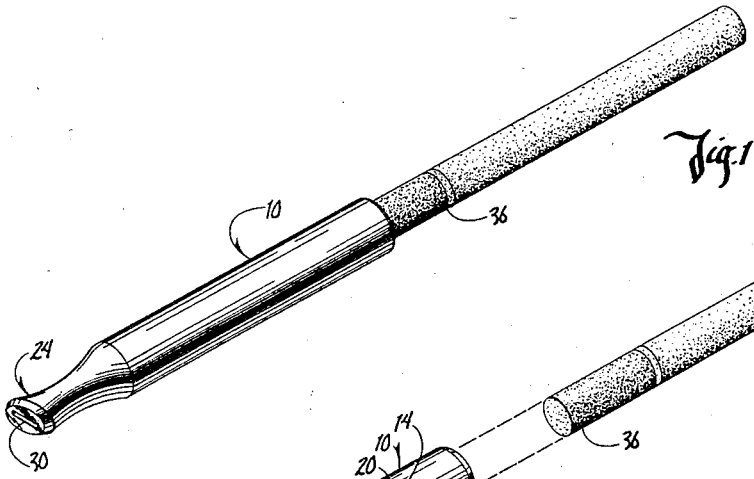
Fig. 1
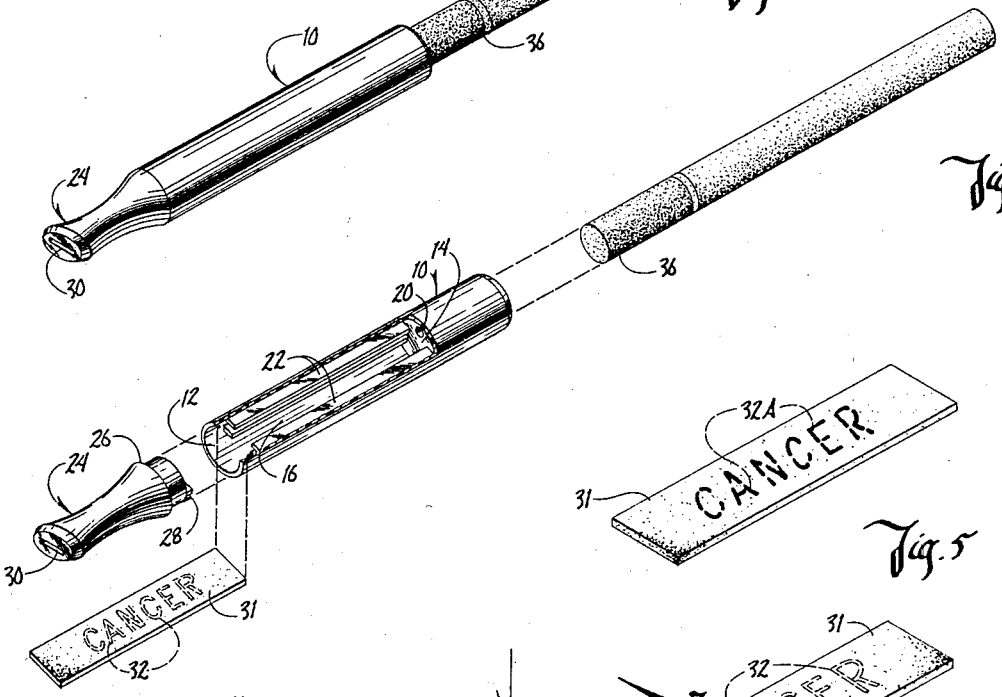
Fig. 2
Fig. 5
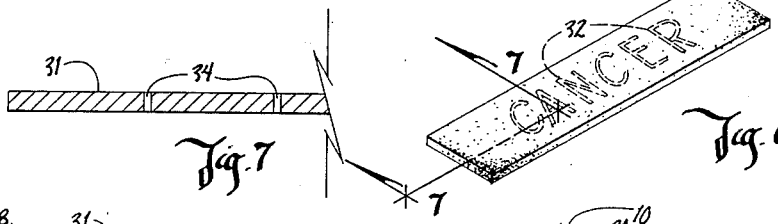
Fig. 6
Fig. 7
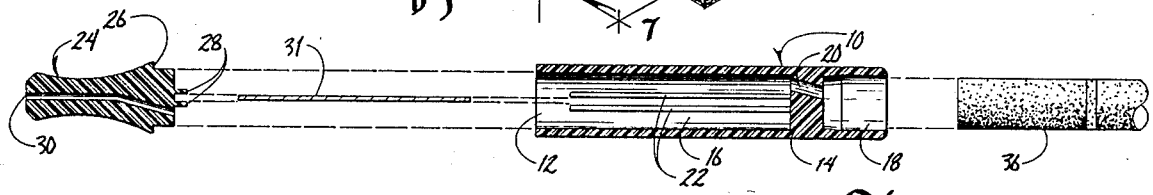
Fig. 3
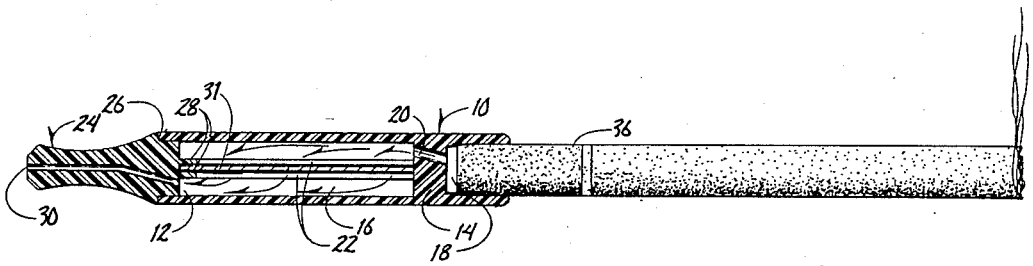
Fig. 4

METHOD AND DEVICE FOR DISCOURAGING CIGARETTE SMOKING

BACKGROUND OF THE INVENTION

Numerous articles have been devised to discourage smoking. None of the devices in the prior art create a graphic visual impact of the dangers of smoking derived from the smoking activity.

BRIEF SUMMARY OF THE INVENTION

This invention comprises a cigarette filter means having a mouthpiece which is separated from a cigarette retention means by a passageway. A filter paper is placed in the passageway. The filter paper has been made invisibly pervious only within the configuration thereon of a written word or words, such as "cancer", "emphysema", etc. The written word or words are invisibly printed on the filter so that they will be the pervious portion of the paper of the filter. The printing will be substantially invisible to the naked eye.

The method of the invention calls for placing a cigarette in the cigarette retention means, lighting the cigarette, withdrawing smoke from the lighted cigarette so that the smoke passes into the passageway and through the pervious portions in the filter paper whereupon the letters or background of said words will entrap particles from the smoke so as to make the letters of the word visible.

Thus, the principal object of this invention is to provide a method and means of discouraging cigarette smoking by alerting the smoker graphically and visually to the dangers of smoking through the act of smoking itself.

These and other objects will be apparent to those skilled in the art.

BRIEF DESCIPTION OF THE DRAWINGS

FIG. 1 is a perspective view of the device of this invention with a cigarette imposed therein;

FIG. 2 is an exploded view of the device of FIG. 1 showing the various components thereof;

FIG. 3 is an exploded sectional view of the device of this invention;

FIG. 4 is a sectional view similar to that of FIG. 3 but with the components of the invention in their assembled condition;

FIG. 5 is a perspective view of the filter paper of this invention as shown at an enlarged scale after cigarette smoke has been drawn therethrough;

FIG. 6 is a view of the filter paper similar to that of FIG. 5, but shows the filter paper prior to being subjected to the passage of cigarette smoke therethrough; and FIG. 7 is a partial sectional view thorugh the filter paper shown on an enlarged scale and taken on line 7—7 of FIG. 6.

DESCRIPTION OF THE PREFERRED EMBODIMENT

The numeral 10 generally designates a transparent cylindrical body member which has an open end 12 and a solid closed end 14. A passageway 16 in body member 10 communicates with open end 12. A cigarette retention well 18 is formed in the end 14 and communicates with passageway 16 by means of conduit 20.

A pair of elongated filter supports 22 are spaced apart and are located on opposite sides of the interior of passageway 16 as best shown in FIGS. 2 and 3. A mouthpiece 24 having a shoulder 26 is adapted to be frictionally and removably inserted into the open end 12 of body member 10. A pair of filter supports 28 are formed in the end of mouthpiece 24 adjacent shoulder 26 and are adapted to be aligned with the filter supports 22 in passageway 16. A conduit 30 extends longitudinally through mouthpiece 24.

A rectangular shaped filter paper 31 has letters 32 invisibly printed thereon by any means which will block the pervious quality of the paper *except* within the confines of (or the background of) the letters of the word or words so printed. One means is to use paper similar to mimeograph paper on which the word or words have been typewritten without a colored ribbon. The letters of the typing then become the pervious or porous area through which the smoke can pass. Another means would be to coat the paper with a clear solution such as parafin except the area of the letters of the word or words used so that only the letters will allow the passage of smoke. Another means would be to affix the filter paper over an impervious paper or cardboard on which the word or words have been stencil cut so that when so laminated the smoke can pass through the filter paper only within the configuration of the stenciled word. The purpose of any such means so employed is to have the filter paper appear to be clear and devoid of any lettering until it is subjected to the passage of smoke through it. The "message" of the word or words is communicated to the smoker only by his use of the invention, a sort of "self-warning". The letters 32 should contain a word or message alerting the user to the dangers of smoking. A typical word would be "cancer" as shown in the drawings.

A conventional cigarette 36 is adapted to have its filter end inserted into the cigarette retention well 18 as shown in FIG. 4.

The normal use and operation of the device of this invention is as follows:

A filter paper 31 of the type described is mounted between the filter supports 22 in passageway 16 by sliding the filter between the supports when the mouthpiece 24 is removed from body member 10. The mouthpiece is then reinserted into the open end 12 of body member 10 so that the filter supports 28 on the mouthpiece align themselves with the filter supports 22, whereupon the filter supports 28 embrace one end of the filter paper 31.

A cigarette 36 is inserted into the well 18, and the cigarette is lighted. The smoker then draws the mouthpiece 24 causing smoke from the burning cigarette to pass through the body of the cigarette into the bottom of well 18, thence through the conduit 20, thence into the upper portion of passageway 16, thence through the pervious portions 34 of filter paper 31, thence into the bottom portion of passageway 16, and thence through the conduit 30 in mouthpiece 24.

The colloidal particles of the cigarette smoke will immediately collect upon the pervious portions of the filter paper 31 as defined by the perforations 34. These particles, such as tars and the like, will immediately discolor the filter paper in the pervious locations of 34, and will thereupon make very visible the letters 32A defined by the perforations 34. Prior to the passage of smoke through filter paper 31, the letters 32 are essentially invisible.

The device and method of this invention will graphically and visibly demonstrate to the user the harmful effects of cigarette smoke, as manifested by the depositing of smoke impurities on filter 31. The impact of the phenomenon is enhanced when the impurities in the smoke spell out a word or expression that denotes a dangerous effect of cigarette smoking.

It is thus seen that this invention achieves at least its stated objectives.

I claim:

1. The method of discouraging cigarette smoking, comprising, taking a cigarette filter means having a mouthpiece oppositely disposed from a cigarette retention means with a transparent therebetween, taking a substantially impervious filter paper and treating a portion thereof to create a pervious portions in said filter paper that will define at least a word directed to the dangers of smoking, with said word being substantially invisible to the naked eye, imposing said paper in said passageway so as to close the free passage of smoke from said cigarette retention means to said mouthpiece, placing a cigarette in said cigarette retention means, lighting said cigarette, withdrawing smoke from said lighted cigarette through said passageway so that smoke from said lighted cigarette will move from the cigarette through the pervious portions in said paper to said mouthpiece, whereupon the letters of said word will entrap particles from said smoke so as to make visible the letters of said word.

2. The device of claim 1 wherein support means is provided in said passageway to support said filter means so that said filter means will divide said passageway into two portions.

3. The device of claim 2 wherein said support means comprises pairs of spaced apart elongated members extending along the interior surface of said passageway.

4. A device for discouraging cigarette smoking, comprising, an elongated transparent body member having an interior passageway, a mouthpiece on one end of said body member, a cigarette retention means in the other end of said body member, and a substantially impervious filter means positioned in said passageway and having pervious portions so that smoke moving from said cigarette retention means through said passageway and into said mouthpiece will pass through the pervious portions of said filter means, said filter means comprising a substantially impervious filter paper with said pervious portions defining at least a word directed to the dangers of smoking, with said word being substantially invisible to the naked eye, whereupon, when said smoke moves through said filter means it will pass through said pervious portions which will entrap particles from said smoke so as to make visible the letters of said word.

* * * * *